US006250004B1

(12) United States Patent
Kondo

(10) Patent No.: US 6,250,004 B1
(45) Date of Patent: Jun. 26, 2001

(54) RECYCLABLE PLASTIC ENCLOSURE WITH AN INTEGRALLY-MOLDED CARD HOLDER

(75) Inventor: Hirotaka Kondo, Isehara (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/236,369

(22) Filed: Jan. 25, 1999

(30) Foreign Application Priority Data

Jan. 23, 1998 (JP) ..... 10-011532

(51) Int. Cl.[7] ..... G09F 3/18
(52) U.S. Cl. ..... 40/642.02; 40/649; 40/490
(58) Field of Search ..... 40/492, 490, 611, 40/765, 724, 642.02, 649, 661

(56) References Cited

U.S. PATENT DOCUMENTS

| | | | | |
|---|---|---|---|---|
| 1,500,269 | * | 7/1924 | Reynolds | 40/649 |
| 2,262,058 | * | 11/1941 | Sinclair | 40/649 |
| 3,295,241 | * | 1/1967 | Chiuminatto | 40/490 |
| 3,981,092 | * | 9/1976 | Ramsdale | 40/765 |
| 4,291,475 | * | 9/1981 | Schoemer | 40/661 X |
| 4,299,043 | * | 11/1981 | Lathrop et al. | 40/611 X |
| 4,531,311 | * | 7/1985 | Howard et al. | 400/649 |
| 4,531,312 | * | 7/1985 | Stoddart | 40/649 |
| 4,593,486 | * | 6/1986 | Visocky et al. | 400/490 |
| 4,679,341 | * | 7/1987 | Goldman | 40/611 |
| 5,488,656 | * | 1/1996 | DeArkland | 40/611 |

FOREIGN PATENT DOCUMENTS

| | | |
|---|---|---|
| 8-034088 | 2/1996 | (JP) . |
| 8-340182 | 12/1996 | (JP) . |

* cited by examiner

*Primary Examiner*—Terry Lee Melius
*Assistant Examiner*—James M Hewitt
(74) *Attorney, Agent, or Firm*—Oblon, Spivak, McClelland, Maier & Neustadt, P.C.

(57) ABSTRACT

An image forming apparatus includes a recyclable molded exterior cover made of plastic with a plate holder at a back side of the cover. The exterior cover is mounted on the apparatus so as to swing between open and close positions. The exterior cover and the plate holder, which holds an information plate, are integrally molded.

41 Claims, 3 Drawing Sheets

RECYCLABLE PLASTIC ENCLOSURE WITH AN INTEGRALLY-MOLDED CARD HOLDER

BACKGROUND OF THE INVENTION

1. Field of the Invention

The present invention relates to a method and apparatus for a recyclable plastic enclosure for use in an office machine, and more particularly to a method and apparatus for a recyclable plastic enclosure which includes an information material holder, for use in an office machine.

2. Discussion of the Background

Designing reusable components for office machines, including image forming apparatuses such as copying machines, facsimile machines, and so forth, has been on its way to becoming popular in response to a recent rising tide of a recycling movement. For example, Japanese Unexamined Patent Publication No. 08-340182 (1996) describes a recyclable enclosure, having a sheet decal, for office machines. This recyclable enclosure can be recycled without removing the sheet decal.

Many office machines are equipped with a transparency case, usually bonded on a surface of a recyclable exterior cover of the office machine, for holding information material such as a business card that indicates various kinds of information including contacts for supplies, repairs, and so forth. Such a case is generally made of PP (polypropylene) resins while the recyclable exterior cover is made of ABS (acrylonitrile butadiene styrene) resins. Since the PP resins have no compatibility with the ABS resins, recycling of the ABS exterior cover together with the PP case produces a resin having an inferior characteristic. Therefore, the ABS exterior cover needs to undergo a recycling process after the PP case is removed therefrom.

To solve this problem, a transparency case made of PS (polystyrene) resins which has a compatibility with ABS resins has been recently studied, to be bonded on a surface of a recyclable cover of an office machine. In this case, however, a bonding material may become a foreign substance for the ABS resin recycling operation even though the transparency case is no longer a foreign substance.

Therefore, it is believed that there is no office apparatus which includes a recyclable plastic enclosure which includes an information material holder and which can be recycled together with the information material.

SUMMARY OF THE INVENTION

Accordingly, an object of the present invention is to provide a novel office apparatus which includes a recyclable plastic enclosure which includes an information material holder and which can be recycled together with the information material holder.

To achieve these and other objects, the piesent invention provides a novel office apparatus that includes a recyclable exterior cover. In one embodiment, an office apparatus includes an exterior cover and a card holder. The exterior cover is a recyclable molded component made of plastic and swingably mounted on the apparatus. The plate holder holds an information plate. The exterior cover and the plate holder are integrally molded.

The information plate may indicate information related to at least one of operations and maintenance of the apparatus.

The information plate may indicate information related to contacts for ordering at least one of supplies and repairs for the apparatus.

The plate holder may include a plurality of integrally-molded projections and depressions.

The plate holder may include a projection for protecting the information plate against slip-off from the plate holder.

The exterior cover may integrally form the plate holder at a back side thereof.

To achieve the above-mentioned and other objects, the present invention also provides a recyclable plastic molded cover for use in an apparatus. The recyclable plastic molded cover includes an exterior cover and a plate holder. In one embodiment, the exterior cover is a recyclable molded component made of plastic and covers a body of the apparatus. The plate holder holds an information plate. The exterior cover and the plate holder are integrally molded.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
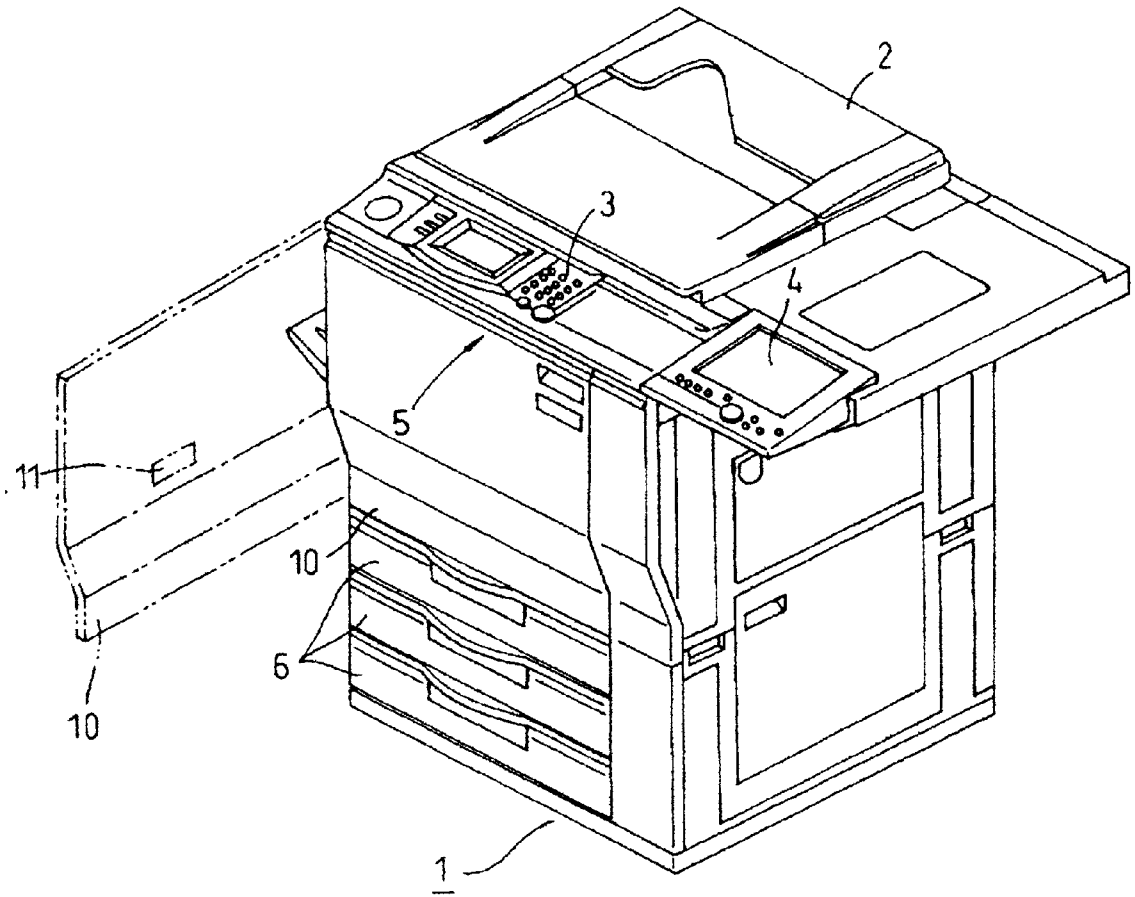
FIG. 1 is a schematic diagram for explaining an image forming apparatus according to an embodiment of the present invention.

In describing a preferred embodiment of the present invention illustrated in the drawings, specific terminology is employed for the sake of clarity. However, the present invention is not intended to be limited to the specific terminology so selected and it is to be understood that each specific element includes all technical equivalents which operate in a similar manner.

Referring now to the drawings, wherein like reference numerals designate identical or corresponding parts throughout the several views, and more particularly to FIG. 1 thereof, there is illustrated an image forming apparatus 1 according to an embodiment of the present invention. The image forming apparatus 1 of FIG. 1 includes on a top portion thereof a plate 2, a console unit 5, and so forth. The plate 2 holds an original document at a reading position with a slight pressure, and is swingably held on the top portion of the image forming apparatus 1. When swung open, the plate 2 provides an opening where an operator accesses a position for original documents. The console 5 includes a switch pad 3 for mounting a plurality of switches for controlling operations of the image forming apparatus 1, a display unit 4 for indicating information such as a status of currently executing operation, for example, and so forth. The image forming apparatus 1 further includes a front exterior cover 10 and an image forming unit (not shown) in a mid-portion thereof, and a plurality of sheet cassettes 6 in a bottom portion thereof, as illustrated in FIG. 1.

The front exterior cover 10 of the image forming apparatus 1 is a recyclable component made of plastic such as ABS (acrylonitrile butadiene styrene) resins, and is swingably mounted on the mid portion and a front side of the image forming apparatus 1. When swung to an open position, the front exterior cover 10 provides an opening from which the operator, or a service engineer, is able to access the image forming unit (not shown) which is enclosed inside the image forming unit 1. As illustrated with chain lines in FIG. 1, such a front exterior cover 10 includes an integrally-molded card holder 11 which is formed on an inside surface thereof so as to be shown to the operator when she or he swings the front exterior cover 10 open.

Figure 2:
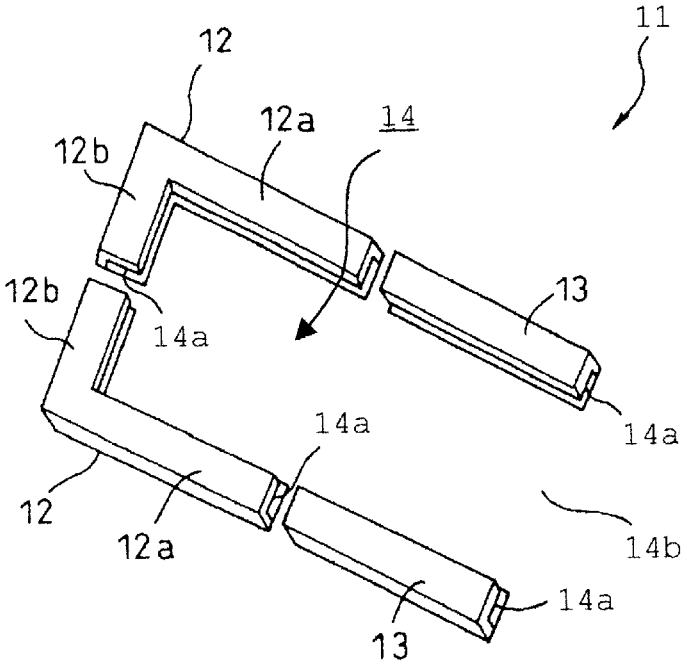
FIGS. 2 and 3 are illustrations for explaining a card holder which is mounted on a front exterior cover of the image forming apparatus of FIG. 1.

As illustrated in FIG. 2, the card holder 11 of the front exterior 10 includes a pair of L-shaped elements 12, each having a vertical bar 12*a* and a horizontal bar 12*b*, and a pair of I-shaped elements 13. Each of these L-shaped elements 12 and I-shaped elements 13 has an L-shaped cross section profile. The L-shaped elements 12 are arranged so that the vertical bars 12*a* thereof are placed in parallel with each other and cut ends of horizontal bars 12*b* thereof closely face each other. Each of I-shaped elements 13 is placed in a line with, leaving clearance from, each of vertical bars 12*a*.

These L-shaped and I-shaped elements 12 and 13 form a card space 14, including a plurality of edge holding spaces 14*a* and an inlet opening 14*b*, relative to a surface of the front exterior cover 10. Each of the edge holding spaces 14*a* is formed under each of the L-shaped and I-shaped elements 12 and 13 relative to the surface of the front exterior cover 10. The inlet opening 14*b* is formed between the I-shaped elements 13 at their sides not adjacent to the vertical bars 12*a*. The card space 14 has a sufficient largeness to accommodate various kinds of information plates such as business cards, for example. For this purpose, the edge holding spaces 14*a* and inlet opening 14*b* correspond to a thickness of and a width of such an information plate, respectively.

Figure 3:
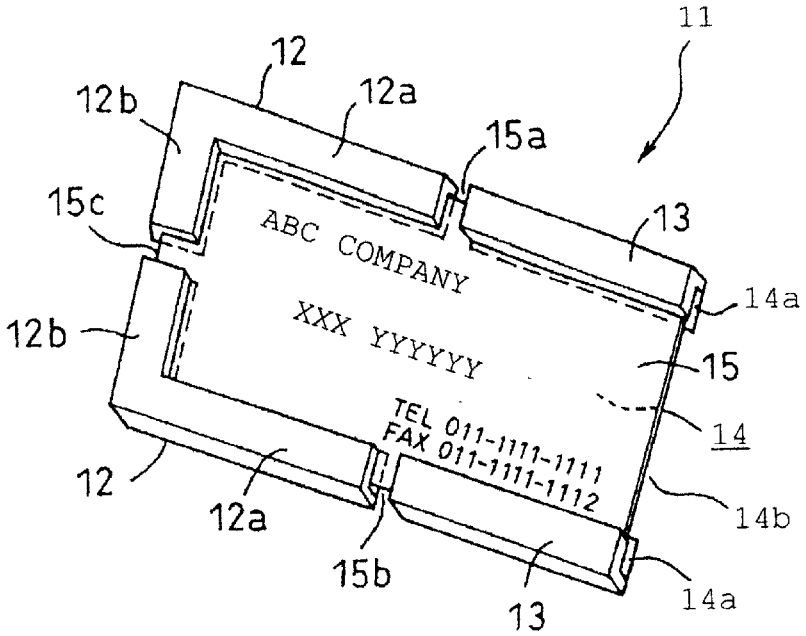

FIG. 3 shows a manner in which the card holder 11 holds a regular-sized landscape business card 15, for example, in a landscape orientation. As illustrated in FIG. 3, the regular-sized landscape business card 15 includes a top edge 15*a*, a bottom edge 15*b*, and a leading side edge 15*c*. When the regular-sized landscape business card 15 is inserted into the card space 14 through the inlet opening 14*b*, the top and bottom edges 15*a* and 15*b* are held with inside surfaces of vertical bars 12*a* of the L-shaped elements 12 and the I-shaped elements 13. Further, the leading side edge 15*c* is held with inside surfaces of the horizontal bars 12*b*. In this way, the regular-sized landscape business card 15 can be held by the card holder 11 so as to be hidden when the front exterior cover 10 is closed and to be shown to the operator when the front exterior cover 10 is opened.

Figure 4:
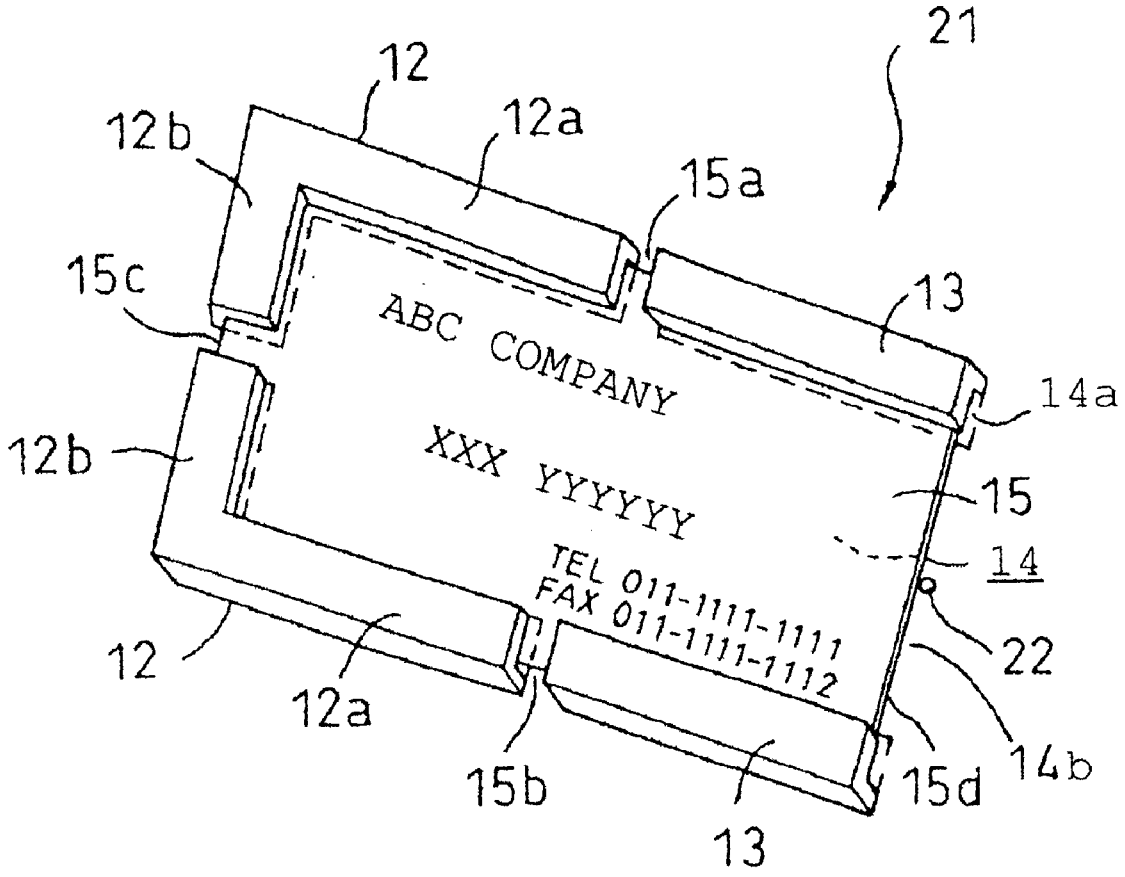
FIG. 4 is an illustration for explaining a modified card holder which includes a projection on a surface of the cover of the image forming apparatus of FIG. 1.

An example of a modified card holder 21 will now be explained with reference to FIG. 4. The modified card holder 21 of FIG. 4 is similar to the card holder 11 of FIG. 2, except for a projection 22. The projection 22 of the modified card holder 21 is formed on the surface of the front exterior cover 10 at a position of an approximate center of the inlet opening 14*b*, and stops the business card 15 from dropping down therefrom.

Being inserted into the modified card holder 21, the regular-sized landscape business card 15 is ridden on the projection 22 and then slipped into the inlet opening 14*b* of the card space 14. When the regular-sized landscape business card 15 is completely held by the modified card holder 21, the top and bottom edges 15*a* and 15*b* of the regular-sized landscape business card 15 are held with the inside surfaces of vertical bars 12*a* of the L-shaped elements 12 and the I-shaped elements 13. Further, the leading side edge 15*c* is held inside surfaces of the horizontal bars 12*b*. At this time, the trailing side edge 15*d* of the regular-sized landscape business card 15 is held by the projection 22. In this way, the regular-sized landscape business card 15 can be held by the modified card holder 21, with a protection against slip-off, so as to be hidden when the front exterior cover 10 is closed and to be shown to the operator when the front exterior cover 10 is opened.

In order to cope with a portrait information plate, the above-described exemplary card holders may be arranged with a ninety-degree displacement, with the horizontal bars 12*b* of the L-shaped elements 12 positioned at the bottom.

Obviously, numerous additional modifications and variations of the present invention are possible in light of the above teachings. It is therefore to be understood that within the scope of the appended claims, the present invention may be practiced otherwise than as specifically described herein.

This document is based on Japanese patent application No. JPAP10-011532 filed in the Japanese Patent Office on Jan. 23, 1998, the entire contents of which are hereby incorporated by reference.

What is claimed as new and is desired to be secured by Letters Patent of the United States is:

1. An image forming apparatus, comprising:

a recyclable molded exterior cover made of plastic, swingably mounted on said apparatus; and a plate holder configured to receive and hold an information plate, wherein said exterior cover and said plate holder are integrally molded, and wherein said plate holder comprises a pair of integrally-molded L-shaped elements and a pair of integrally-molded I-shaped elements, said integrally-molded L-shaped elements respectively having vertical portions thereof arranged in parallel with each other and having cut-ends of respective horizontal portions thereof facing each other, said integrally-molded I-shaped elements being arranged in a line with a vertical portion of a respective integrally-molded L-shaped element.

2. An image forming apparatus of claim 1, wherein said information plate indicates information related to at least one of the members of the group consisting of operations and maintenance of said apparatus.

3. An image forming apparatus of claim 1, wherein said information plate indicates information related to contacts for ordering at least one of the members of the group consisting of supplies and repairs for said apparatus.

4. An image forming apparatus of claim 1, wherein said plate holder comprises a projection for protecting said information plate against slip-off from said plate holder.

5. An image forming apparatus of claim 1, wherein said plate holder is positioned at a back side of said exterior cover.

6. An image forming apparatus of claim 1, wherein a clearance exists between each of the L-shaped and I-shaped elements.

7. An image forming apparatus of claim 1, wherein each of the L-shaped and I-shaped elements includes a groove therein configured to receive the information plate.

8. An image forming apparatus, comprising:

an exterior cover means for covering a body of said apparatus, said exterior cover means being a recyclable molded component made of plastic and swingably mounted on said apparatus; and a plate holding means for holding an information plate, wherein said exterior cover means and said plate holding means are integrally molded, and wherein said plate holding means comprises a pair of integrally-molded L-shaped elements and a pair of integrally-molded I-shaped elements, said integrally-molded L-shaped elements respectively having vertical portions thereof arranged in parallel with each other and having cut-ends of respective horizontal portions thereof facing each other, said integrally-molded I-shaped elements being arranged in a line with a vertical portion of a respective integrally-molded L-shaped element.

9. An image forming apparatus of claim 8, wherein said information plate indicates information related to at least one of the members of the group consisting of operations and maintenance of said apparatus.

10. An image forming apparatus of claim 8, wherein said information plate indicates information related to contacts for ordering at least one of the members of the group consisting of supplies and repairs for said apparatus.

11. An image forming apparatus of claim 8, wherein said plate holding means comprises a projection for protecting said information plate against slip-off from said plate holder.

12. An image forming apparatus of claim 8, wherein said plate holding means is positioned at a back side of said exterior cover means.

13. An image forming apparatus of claim 8, wherein a clearance exists between each of the L-shaped and I-shaped elements.

14. An image forming apparatus of claim 8, wherein each of the L-shaped and I-shaped elements includes a groove therein configured to receive the information plate.

15. A method for providing a holder for an information plate on an image forming apparatus, comprising the steps of:

molding an exterior cover having an integrally-molded plate holder which receives and holds an information plate, said exterior cover configured to cover a body of said apparatus; and mounting said exterior cover on said apparatus so that said exterior cover is capable of swinging between open and closed positions, wherein molding said exterior cover comprises molding a recyclable plastic, and wherein said plate holder comprises a pair of integrally-molded L-shaped elements and a pair of integrally-molded I-shaped elements, said integrally-molded L-shaped elements respectively having vertical portions thereof arranged in parallel with each other and having cut-ends of respective horizontal portions thereof facing each other, said integrally-molded I-shaped elements being arranged in a line with a vertical portion of a respective integrally-molded L-shaped element.

16. A method of claim 15, wherein said molding step comprises molding a projection for protecting said information plate against slip-off from said plate holder.

17. A method of claim 15, wherein said molding step comprises molding said plate holder at a back side of said exterior cover.

18. A method of claim 15, wherein a clearance exists between each of the L-shaped and I-shaped elements.

19. A method of claim 15, wherein each of the L-shaped and I-shaped elements includes a groove therein configured to receive the information plate.

20. A recyclable plastic molded cover for use in an apparatus, comprising:

a recyclable molded exterior cover made of plastic, said exterior cover covering a body of said apparatus; and a plate holder configured to receive and hold an information plate, wherein said exterior cover and said plate holder are integrally molded, and wherein said plate holder comprises a pair of integrally-molded L-shaped elements and a pair of integrally-molded I-shaped elements, said integrally-molded L-shaped elements respectively having vertical portions thereof arranged in parallel with each other and having cut-ends of respective horizontal portions thereof facing each other, said integrally-molded I-shaped elements being arranged in a line with a vertical portion of a respective integrally-molded L-shaped element.

21. A recyclable plastic molded cover of claim 20, wherein said information plate indicates information related to at least one of the members of the group consisting of operations and maintenance of said apparatus.

22. A recyclable plastic molded cover of claim 20, wherein said information plate indicates information related to contacts for ordering at least one of the members of the group consisting of supplies and repairs.

23. A recyclable plastic molded cover of claim 20, wherein said plate holder comprises a projection for protecting said information plate against slip-off from said plate holder.

24. A recyclable plastic molded cover of claim 20, said plate holder is positioned at a back side of said exterior cover.

25. A recyclable plastic molded cover of claim 20, wherein a clearance exists between each of the L-shaped and I-shaped elements.

26. A recyclable plastic molded cover of claim 20, wherein each of the L-shaped and I-shaped elements includes a groove therein configured to receive the information plate.

27. A recyclable plastic molded cover for use in an apparatus, comprising:

an exterior cover means for covering a body of said apparatus, said exterior cover means being a recyclable molded component made of plastic; and a plate holding means for receiving and holding an information plate, wherein said exterior cover means and said plate holding means are integrally molded, and wherein said plate holding means comprises a pair of integrally-molded L-shaped elements and a pair of integrally-molded I-shaped elements, said integrally-molded L-shaped elements respectively having vertical portions thereof arranged in parallel with each other and having cut-ends of respective horizontal portions thereof facing each other, said integrally-molded I-shaped elements being arranged in a line with a vertical portion of a respective integrally-molded L-shaped element.

28. A recyclable plastic molded cover of claim 27, wherein said information plate indicates information related to at least one of the members of the group consisting of operations and maintenance of said apparatus.

29. A recyclable plastic molded cover of claim 27, wherein said information plate indicates information related to contacts for ordering at least one of the members of the group consisting of supplies and repairs for said apparatus.

30. A recyclable plastic molded cover of claim 27, wherein said plate holding means comprises a projection for protecting said information plate against slip-off from said plate holder.

31. A recyclable plastic molded cover of claim 27, wherein said plate holding means is positioned at a back side of said exterior cover means.

32. A recyclable plastic molded cover of claim 27, wherein a clearance exists between each of the L-shaped and I-shaped elements.

33. A recyclable plastic molded cover of claim 27, wherein each of the L-shaped and I-shaped elements includes a groove therein configured to receive the information plate.

34. A method for providing a holder for an information plate on a cover for use on an apparatus, comprising the steps of:

molding an exterior cover having an integrally-molded plate holder which receives and holds an information plate, said exterior cover configured to cover a body of said apparatus;

mounting said exterior cover on said apparatus so that said exterior cover is capable of swinging between open and closed positions;

wherein molding said exterior cover comprises molding a recyclable plastic, and wherein said plate holder comprises a pair of integrally-molded L-shaped elements and a pair of integrally-molded I-shaped elements, said integrally-molded L-shaped elements respectively having vertical portions thereof arranged in parallel with each other and having cut-ends of respective horizontal portions thereof facing each other, said integrally-molded I-shaped elements being arranged in a line with a vertical portion of a respective integrally-molded L-shaped element.

35. A method of claim 34, wherein said molding step comprises molding a projection for protecting said information plate against slip-off from said plate holder.

36. A method of claim 34, wherein said molding step comprises molding said plate holder at a back side of said exterior cover.

37. A method of claim 34, wherein a clearance exists between each of the L-shaped and I-shaped elements.

38. A method of claim 34, wherein each of the L-shaped and I-shaped elements includes a groove therein configured to receive the information plate.

39. An image forming apparatus comprising:

a recyclable molded exterior cover made of plastic, said exterior cover covering a body of said apparatus; and a plate holder configured to receive and hold an information plate, wherein said exterior cover and said plate holder are integrally molded, and wherein said plate holder comprises a pair of integrally-molded L-shaped elements respectively having vertical portions thereof arranged in parallel with each other and having cut-ends of respective horizontal portions thereof facing each other.

40. An image forming apparatus comprising:

an exterior cover means for covering a body of said apparatus, said exterior cover means being a recyclable molded component made of plastic; and a plate holding means for receiving and holding an information plate, wherein said exterior cover means and said plate holding means are integrally molded, and wherein said plate holder comprises a pair of integrally-molded L-shaped elements respectively having vertical portions thereof arranged in parallel with each other and having cut-ends of respective horizontal portions thereof facing each other.

41. A method for providing a holder for an information plate on an image forming apparatus, comprising the steps of:

molding an exterior cover having an integrally-molded plate holder which receives and holds an information plate, said exterior cover configured to cover a body of said apparatus;

mounting said exterior cover on said apparatus so that said exterior cover is capable of swinging between open and closed positions;

wherein molding said exterior cover comprises molding a recyclable plastic, and wherein said plate holder comprises a pair of integrally-molded L-shaped elements respectively having vertical portions thereof arranged in parallel with each other and having cut-ends of respective horizontal portions thereof facing each other.

* * * * *